US011352772B2

(12) United States Patent
Ye et al.

(10) Patent No.: US 11,352,772 B2
(45) Date of Patent: Jun. 7, 2022

(54) REMOTE CONTROL WATER OUTLET DEVICE

(71) Applicant: Xiamen Lota International Co., Ltd., Fujian (CN)

(72) Inventors: Liming Ye, Fujian (CN); Yan Zhang, Fujian (CN); Weibing Li, Fujian (CN); Chuanbao Zhu, Fujian (CN)

(73) Assignee: Xiamen Lota International Co., Ltd., Fujian (CN)

( * ) Notice: Subject to any disclaimer, the term of this patent is extended or adjusted under 35 U.S.C. 154(b) by 32 days.

(21) Appl. No.: 17/120,589

(22) Filed: Dec. 14, 2020

(65) Prior Publication Data

US 2021/0180301 A1 Jun. 17, 2021

(30) Foreign Application Priority Data

Dec. 12, 2019 (CN) ..... 201922226372.7

(51) Int. Cl.
*E03C 1/05* (2006.01)
*E03C 1/02* (2006.01)

(52) U.S. Cl.
CPC ..... *E03C 1/052* (2013.01); *E03C 1/023* (2013.01); *E03C 2001/026* (2013.01)

(58) Field of Classification Search
CPC ..... E03C 1/052; E03C 1/023; E03C 2001/026
USPC ..... 4/675–678
See application file for complete search history.

(56) References Cited

U.S. PATENT DOCUMENTS

| | | | | |
|---|---|---|---|---|
| 5,031,258 | A * | 7/1991 | Shaw | E03C 1/057 4/304 |
| 7,979,928 | B2 * | 7/2011 | Allen, Jr. | E03C 1/057 4/623 |
| 2004/0200987 | A1 * | 10/2004 | Houghton | E03C 1/052 137/607 |
| 2005/0178452 | A1 * | 8/2005 | Vilhelmsen | E03C 1/052 137/801 |

* cited by examiner

*Primary Examiner* — Tuan N Nguyen
(74) *Attorney, Agent, or Firm* — Cooper Legal Group, LLC

(57) ABSTRACT

A remote control water outlet device comprises a faucet and a control assembly. The faucet is connected to one or more water inlet pipes and a water outlet pipe assembly, and the control assembly is separated from the faucet by a distance. The control assembly controls the water outlet pipe assembly to be opened and to be closed. The water outlet pipe assembly comprises a water inlet passage and a water outlet passage in communication with the control assembly. The control assembly comprises a pressure relief cavity in communication with the water inlet passage and a sealing gasket configured to abut and block inlets of the water outlet passage due to being subjected to water pressure in the pressure relief cavity. The sealing gasket comprises a control hole configured to be opened to enable the pressure relief cavity be in communication with the water inlet passage.

10 Claims, 6 Drawing Sheets

REMOTE CONTROL WATER OUTLET DEVICE

RELATED APPLICATIONS

This application claims priority to Chinese patent application number 201922226372.7, filed on Dec. 12, 2019. Chinese patent application number 201922226372.7 is incorporated herein by reference.

FIELD OF THE DISCLOSURE

The present disclosure relates to a bathroom water outlet device, and in particular to a remote control water outlet device.

BACKGROUND OF THE DISCLOSURE

The faucet is generally disposed on a countertop at an edge of a basin. The faucet is disposed on an inner side of the basin. When the basin is wide, users are often inconvenienced. Sometimes, the users, for example, children, etc., cannot even reach a handle of the faucet.

BRIEF SUMMARY OF THE DISCLOSURE

The present disclosure provides a water outlet device with low cost and convenient remote control to solve the deficiencies in the existing techniques. A remote switch assembly is configured to be placed on an edge of a basin, and control of the water outlet device by users is convenient.

In order to solve the technical problems, the present disclosure provides a remote control water outlet device.

The remote control water outlet device comprises a faucet disposed on a countertop and a control assembly. The faucet is connected to one or more water inlet pipes and a water outlet pipe assembly, and the control assembly is disposed on the countertop and is separated from the faucet by a distance. The control assembly is in communication with the water outlet pipe assembly and controls the water outlet pipe assembly to be opened and to be closed. The water outlet pipe assembly comprises one or more water inlet passages and one or more water outlet passages in communication with the control assembly. The control assembly comprises a pressure relief cavity in communication with the one or more water inlet passages and a sealing gasket configured to abut and block an inlet of the one or more water outlet passages due to being subjected to water pressure in the pressure relief cavity. The sealing gasket comprises a control hole configured to be opened to enable the pressure relief cavity be in communication with the one or more water inlet passages. When the control hole is opened to release the water pressure in the pressure relief cavity, the sealing gasket unblocks the inlet of the one or more water outlet passages, and the one or more water inlet passages are in communication with the one or more water outlet passages.

In a preferred embodiment, the sealing gasket comprises a fine hole configured to be in communication with the one or more water inlet passages and the pressure relief cavity.

In a preferred embodiment, a diameter of the control hole is larger than a diameter of the fine hole.

In a preferred embodiment, the control assembly comprises a control shaft configured to move axially through the control hole and control the control hole to be opened and to be closed.

In a preferred embodiment, the control hole is circumferentially disposed with a sealing ring, and the control shaft is circumferentially disposed with a given annular groove radially shrinking inward. When the control shaft moves axially to enable the given annular groove to correspond to the sealing ring, the pressure relief cavity is in communication with the one or more water outlet passages.

In a preferred embodiment, the control assembly comprises an intermittent movement mechanism operatively connected to the control shaft.

In a preferred embodiment, the water outlet pipe assembly comprises a connector assembly. The one or more water inlet passages comprise a first water inlet passage connected to the control assembly and the connector assembly and a second water inlet passage connected to the faucet and the connector assembly. The one or more water outlet passages comprise a first water outlet passage connected to the control assembly and the connector assembly and a second water outlet passage connected to the faucet and the connector assembly.

In a preferred embodiment, the connector assembly comprises a connector body, and the first water inlet passage, the second water inlet passage, the first water outlet passage, and the second water outlet passage are all detachably connected to the connector body.

In a preferred embodiment, the connector body is disposed with a check valve at a connection position between the connector body and the second water inlet passage.

In a preferred embodiment, the faucet comprises a switching valve configured to be in communication with the one or more water inlet pipes and the water outlet pipe assembly, and the switching valve controls the water outlet pipe assembly to be opened and to be closed.

Compared with the existing techniques, the technical solution has the following advantages.

The control assembly can be separated from the faucet by a preset distance, and water discharging of the faucet can be achieved due to the water outlet pipe assembly being controlled to be opened and to be closed. The control assembly can be disposed on a side of the basin adjacent to the user, which is convenient for control by the user.

DETAILED DESCRIPTION OF THE EMBODIMENTS

The present disclosure will be further described below in combination with the accompanying drawings and embodiments.

Hereinafter, certain directional terms are used to describe the drawings, such as "inner", "outer", "above", "below", and other directional terms, and should be understood to have their normal meanings and refer to the directions of the drawings taken normally. Unless otherwise specified, the directional terms described in this specification basically follow conventional directions understood by those skilled in the art.

The terms "first", "second", and similar terms used in the present disclosure do not indicate any order, quantity, or importance in the present disclosure, but are configured to distinguish one part from other parts.

Figure 1:
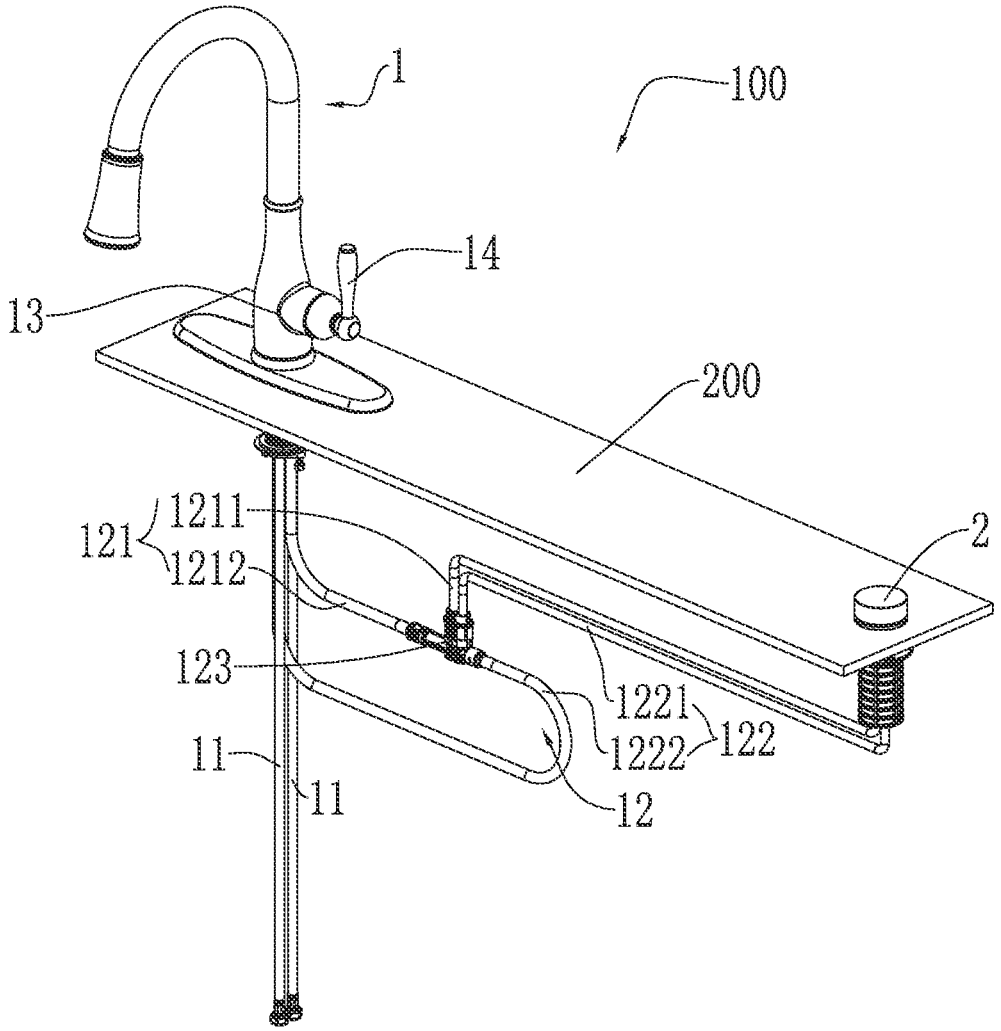
FIG. 1 illustrates a perspective view of a water outlet device in an embodiment of the present disclosure.
Figure 2:
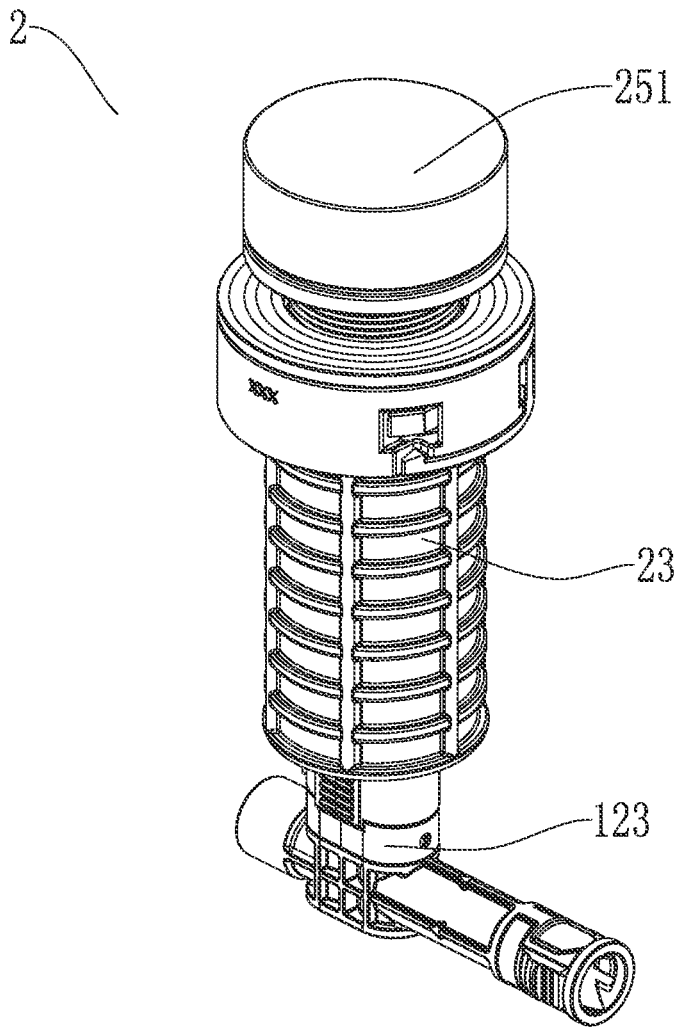
FIG. 2 illustrates a perspective view of a control assembly in the embodiment of the present disclosure.
Figure 3:
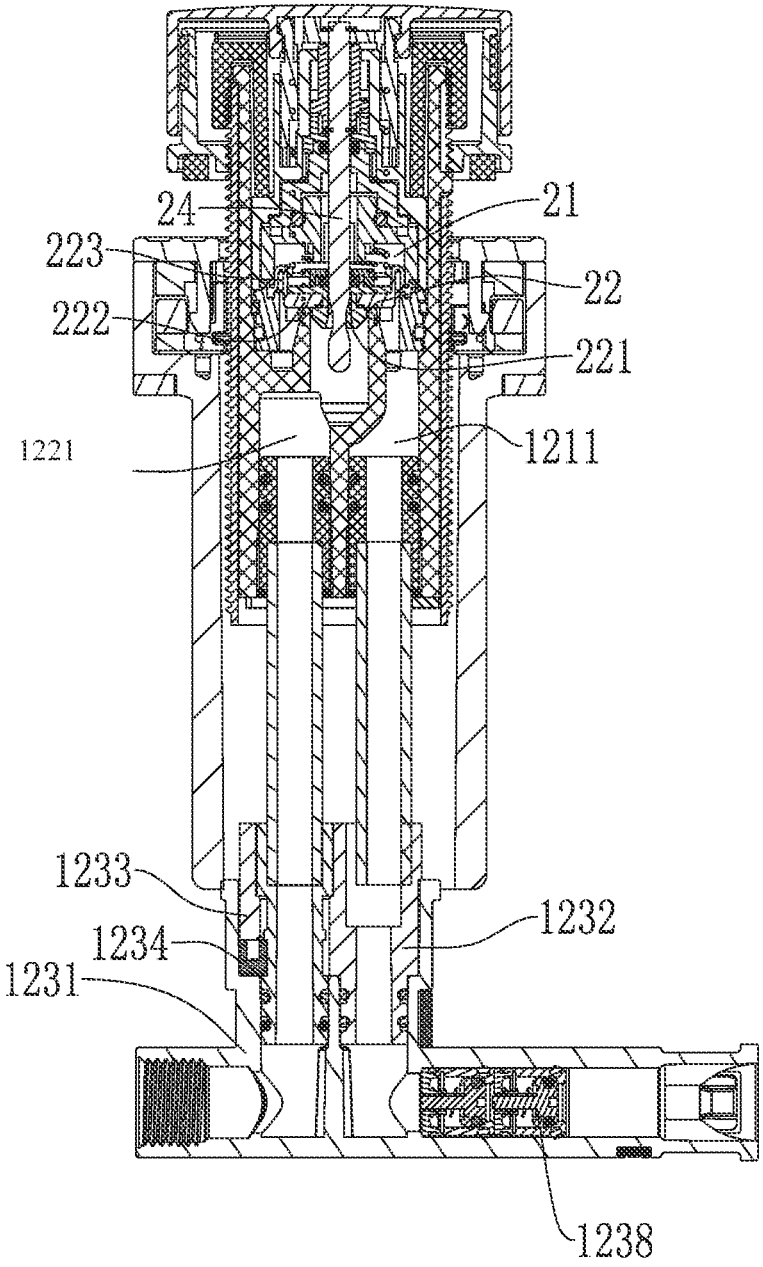
FIG. 3 illustrates a cross-sectional view of the control assembly in the embodiment of the present disclosure.
Figure 4:
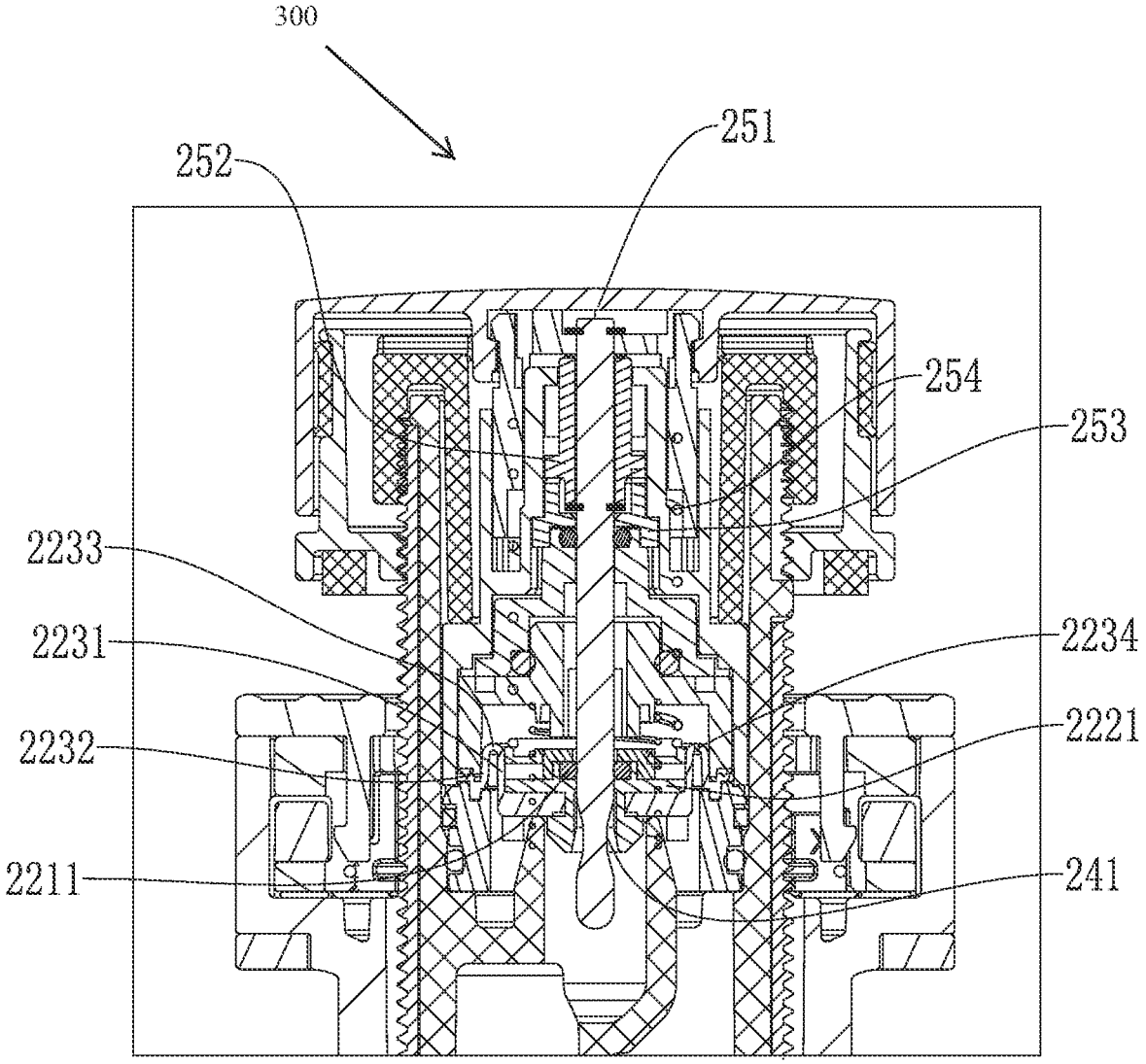
FIG. 4 illustrates a cross-sectional view of a portion of the control assembly in the embodiment of the present disclosure when a control hole is blocked by a control shaft of the control assembly.
Figure 5:
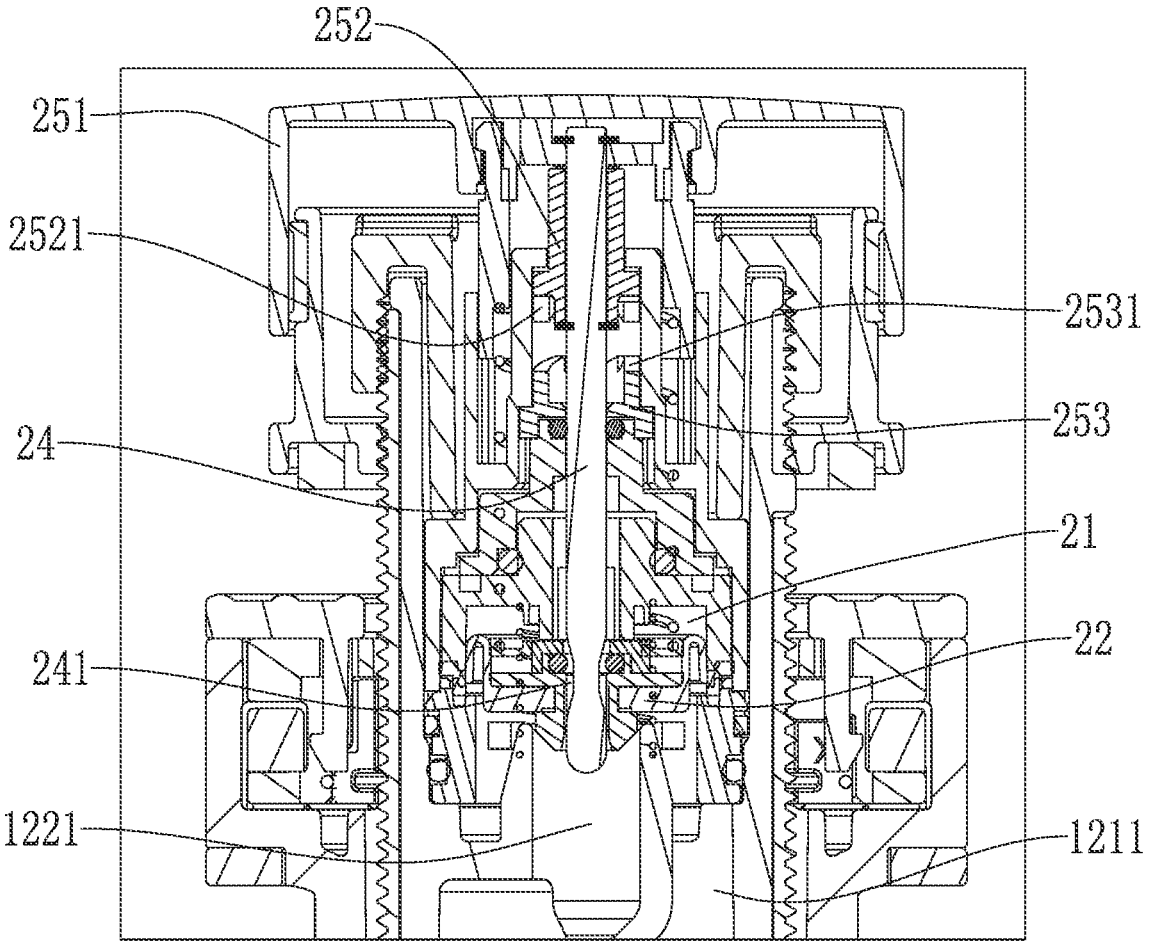
FIG. 5 illustrates a cross-sectional view of the portion of the control assembly in the embodiment of the present disclosure when the control hole is opened (i.e., not blocked by the control shaft) of the control assembly.
Figure 6:
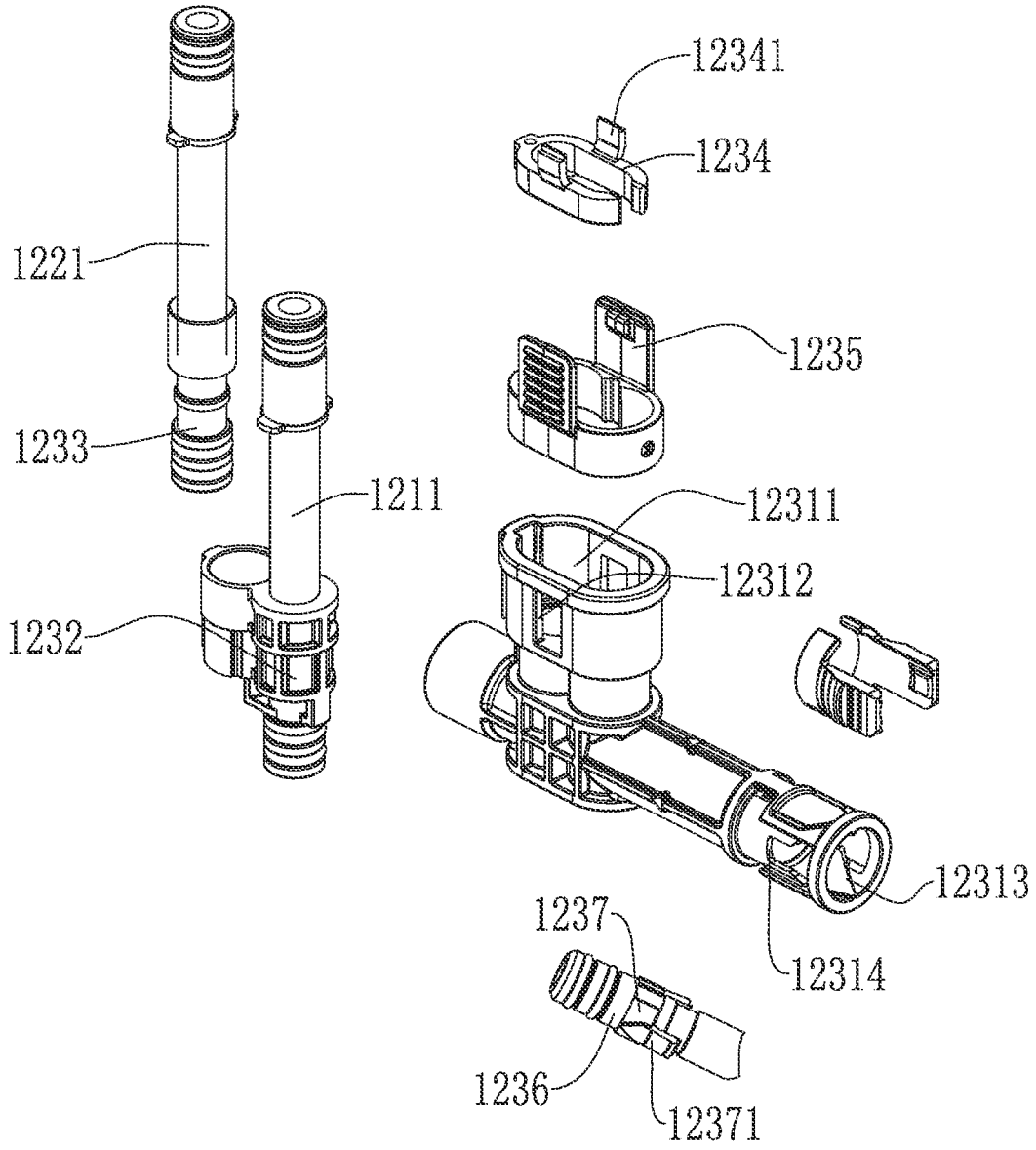
FIG. 6 illustrates an exploded view of a connector assembly in the embodiment of the present disclosure.

Referring to FIGS. 1-6, a remote control water outlet device 100 comprises a faucet 1 and a control assembly 2. The faucet 1 is disposed on a countertop 200, and the faucet 1 is connected to one or more water inlet pipes 11 and a water outlet pipe assembly 12. The control assembly 2 is disposed on the countertop 200 and is separated from the faucet 1 by a distance, and the control assembly 2 is in communication with the water outlet pipe assembly 12 and controls the water outlet pipe assembly 12 to be opened and to be closed. In some embodiments, the water outlet pipe assembly 12 comprises one or more water inlet passages 121 and one or more water outlet passages 122 in communication with the control assembly 2. The control assembly 2 comprises a pressure relief cavity 21 in communication with the one or more water inlet passages 121 and a sealing gasket 22 configured to abut and block inlets of the one or more water outlet passages 122 due to being subjected to water pressure in the pressure relief cavity 21. The sealing gasket 22 comprises a control hole 221 configured to be controlled (e.g., opened) to enable the pressure relief cavity 21 to be in communication with the one or more water inlet passages 121. When the control hole 221 is opened (i.e., the pressure relief cavity 21 is in communication with the one or more water inlet passages 121) to release the water pressure in the pressure relief cavity 21, the sealing gasket 22 unblocks the inlets of the one or more water outlet passages 122, and the one or more water inlet passages 121 are in communication with the one or more water outlet passages 122.

The faucet 1 further comprises a switching valve 13 configured to be in communication with the one or more water inlet pipes 11 and the water outlet pipe assembly 12, and the switching valve 13 controls the water outlet pipe assembly 12 to be opened and to be closed. In this embodiment, the one or more water inlet pipes 11 comprise two water inlet pipes 11 configured to be respectively in communication with a hot water source and a cold water source, and hot water and cold water flow into the switching valve 13 and flow out to the one or more water inlet passages 121. The faucet 1 further comprises a handle 14 operatively connected to the switching valve 13. When in use, a user firstly switches on the switching valve 13, and the water flows into the one or more water inlet passages 121 and then flows into the control assembly 2.

The control assembly 2 comprises a housing 23, and the pressure relief cavity 21 is disposed in the housing 23 and is configured to be respectively in communication with the one or more water inlet passages 121 and the one or more water outlet passages 122. The sealing gasket 22 comprises an abutting portion 222 configured to abut and close the inlet of the one or more water outlet passages 122 and a deformable portion 223 disposed on a periphery of the abutting portion 222. The deformable portion 223 is fixedly connected to the housing 23. The deformable portion 223 further comprises a first peripheral wall 2231 extending toward the pressure relief cavity 21 and a second peripheral wall 2232 extending away from the pressure relief cavity 21. A connecting wall 2233 is disposed between peripheries of the first peripheral wall 2231 and the second peripheral wall 2232 facing the pressure relief cavity 21. In this embodiment, a portion of the abutting portion 222 configured to abut the inlets of the one or more water outlet passages 122 is made of silicone material, and the deformable portion 223 is made of silicone material. The connecting wall 2233 of the sealing gasket 22 comprises a fine hole 2234 configured to be in communication with the one or more water inlet passages 121 and the pressure relief cavity 21, and a diameter of the control hole 221 is larger than a diameter of the fine hole 2234.

When the control hole 221 is closed, water flows into the pressure relief cavity 21 through the fine hole 2234, and the water pressure in the pressure relief cavity 21 increases, so that the abutting portion 222 blocks the inlet of the one or more water outlet passages 122 due to being subjected to the water pressure. When the control hole 221 is opened, water flows into the one or more water outlet passages 122 from the pressure relief cavity 21, and the water pressure in the pressure relief cavity 21 decreases. At this time, the sealing gasket 22 is affected due to water pressure in the one or more water inlet passages 121, the deformable portion 223 deforms, so that the abutting portion 222 slides toward the pressure relief cavity 21, and the one or more water inlet passages 121 are in communication with the one or more water outlet passages 122 at this time.

A side of the abutting portion 222 facing the pressure relief cavity 21 is further disposed with a reinforcing plate 2221. The reinforcing plate 2221 is made of plastic, and the reinforcing plate 2221 defines the control hole 221. The reinforcing plate 2221 is configured to prevent water leakage from deformation due to the silicone material being easily deformed by the water pressure. The control assembly 2 comprises a control shaft 24 configured to move axially through the control hole 221 and control the control hole 221 to be opened and to be closed. The control hole 221 is circumferentially disposed with a sealing ring 2211, and the control shaft 24 is circumferentially disposed with a given annular groove 241 radially shrinking inward. When the control shaft 24 moves axially to enable the given annular groove 241 to correspond to the sealing ring 2211, the pressure relief cavity 21 is in communication with the one or more water outlet passages 122.

The control assembly 2 further comprises an intermittent movement mechanism 300 operatively connected to the control shaft 24 for reciprocating. A first end of the control shaft 24 is disposed in the control hole 221, and a second end of the control shaft 24 is connected to a button 251. The user only needs to press the button 251 to control the control shaft 24 to reciprocate. In some embodiments, the intermittent movement mechanism 300 comprises a first push rod 252 encompassing an outer side of the control shaft 24. The first push rod 252 is configured to follow the control shaft 24 to move axially and rotate circumferentially about the control shaft 24. The first push rod 252 is further disposed with a first ratchet tooth 2521 facing the control hole 221. The intermittent movement mechanism 300 further comprises a second push rod 253 fixedly connected to the housing 23. The second push rod 253 is further disposed with a second ratchet tooth 2531 facing away from the control hole 221. The user pushes the button 251 to drive the control shaft 24 to slide toward the pressure relief cavity 21 until the first ratchet tooth 2521 abuts the second ratchet tooth 2531. The second ratchet tooth 2531 is further disposed with a ratchet groove configured to be engaged with the first ratchet tooth 2521, and the first ratchet tooth 2521 rotates circumferentially about the control shaft 24 and is embedded in the ratchet groove. At this time, the sealing ring 2211 abuts a peripheral wall of the control shaft 24, and the control hole 221 is closed. When the user presses the button 251 again, the first ratchet tooth 2521 continues to rotate circumferentially about the control shaft 24 and is separated from the ratchet groove, and the control hole 221 slides in a direction away from the pressure relief cavity 21. At this time the given annular groove 241 corresponds to the sealing ring 2211, and water from the pressure relief cavity 21 is configured to flow into the one or more water outlet passages 122. The intermittent movement mechanism 300 further comprises a reset spring 254. The reset spring 254 abuts and is disposed between the housing 23 and the button 251, and the reset spring 254 can improve hand feeling of the button 251.

The water outlet pipe assembly 12 further comprises a connector assembly 123. The one or more water inlet passages 121 comprise a first water inlet passage 1211 connected to the control assembly 2 and the connector assembly 123 and a second water inlet passage 1212 connected to the faucet 1 and the connector assembly 123. The one or more water outlet passages 122 comprise a first water outlet passage 1221 connected to the control assembly 2 and the connector assembly 123 and a second water outlet passage 1222 connected to the faucet 1 and the connector assembly 123.

The connector assembly 123 comprises a connector body 1231, and the first water inlet passage 1211, the second water inlet passage 1212, the first water outlet passage 1221, and the second water outlet passage 1222 are all detachably connected to the connector body 1231. The connector assembly 123 further comprises a first water inlet connector 1232 disposed on the first water inlet passage 1211 and a first water outlet connector 1233 disposed on the first water outlet passage 1221. The connector assembly 123 further comprises a snap sleeve 1234, and the snap sleeve 1234 surrounds outer sides of the first water inlet connector 1232 and the first water outlet connector 1233. The snap sleeve 1234 further comprises a fastener 12341. The connector body 1231 is disposed with an installation groove 12311 configured to enable the first water inlet connector 1232 and the first water outlet connector 1233 to disposed therein, and the installation groove 12311 comprises a snap groove 12312. The first water inlet connector 1232, the first water outlet connector 1233, and the snap sleeve 1234 are disposed in the installation groove 12311 together until the fastener 12341 is snapped in the snap groove 12312, and an installation is completed. The connector assembly 123 further comprises a pressing member 1235 encompassing an outer side of the connector body 1231, and the pressing member 1235 corresponds to the snap groove 12312. The user only needs to press the pressing member 1235 to disengage the fastener 12341 from the snap groove 12312, and the first water inlet connector 1232, the first water outlet connector 1233, and the snap sleeve 1234 can be disassembled.

A connection between the second water outlet passage 1222 and the connector body 1231 defines a screw connection, which will not be further described here. The connector assembly 123 comprises a second water inlet connector 1236 disposed on the second water inlet passage 1212. The connector assembly 123 further comprises a sleeve ring 1237 and a snapping block 12371. The sleeve ring 1237 encompasses an outer side of the second water inlet connector 1236 and is configured to rotate circumferentially, and the snapping block 12371 is disposed on the sleeve ring 1237. The connector body 1231 comprises an insertion groove 12313 configured to enable the second water inlet connector 1236 to be disposed therein. The insertion groove 12313 further comprises a snapping groove 12314. When the second water inlet connector 1236 moves toward the insertion groove 12313, the snapping block 12371 is embedded in the snapping groove 12314.

The connector body 1231 is further disposed with a check valve 1238 at a connection position between the second water inlet passage 1212 and the connector body 1231, and the check valve 1238 is configured to prevent water from flowing backward.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A remote control water outlet device, comprising:
a faucet disposed on a countertop, and
a control assembly, wherein:
the faucet is connected to one or more water inlet pipes and a water outlet pipe assembly,
the control assembly is disposed on the countertop and is separated from the faucet by a distance,
the control assembly is in communication with the water outlet pipe assembly and controls the water outlet pipe assembly to be opened and to be closed,
the water outlet pipe assembly comprises one or more water inlet passages and one or more water outlet passages in communication with the control assembly,
the control assembly comprises a pressure relief cavity in communication with the one or more water inlet passages and a sealing gasket configured to abut and block an inlet of the one or more water outlet passages due to being subjected to water pressure in the pressure relief cavity,
the sealing gasket comprises a control hole configured to be opened to enable the pressure relief cavity be in communication with the one or more water inlet passages, and
when the control hole is opened to release the water pressure in the pressure relief cavity:
the sealing gasket unblocks the inlet of the one or more water outlet passages, and
the one or more water inlet passages are in communication with the one or more water outlet passages.

2. The remote control water outlet device according to claim 1, wherein the sealing gasket comprises a fine hole configured to be in communication with the one or more water inlet passages and the pressure relief cavity.

3. The remote control water outlet device according to claim 2, wherein a diameter of the control hole is larger than a diameter of the fine hole.

4. The remote control water outlet device according to claim 1, wherein the control assembly comprises a control shaft configured to move axially through the control hole and control the control hole to be opened and to be closed.

5. The remote control water outlet device according to claim 4, wherein:
the control hole is circumferentially disposed with a sealing ring,
the control shaft is circumferentially disposed with a given annular groove radially shrinking inward, and when the control shaft moves axially to enable the given annular groove to correspond to the sealing ring, the pressure relief cavity is in communication with the one or more water outlet passages.

6. The remote control water outlet device according to claim 5, wherein the control assembly comprises an intermittent movement mechanism operatively connected to the control shaft.

7. The remote control water outlet device according to any one of claim 1, wherein:

the water outlet pipe assembly comprises a connector assembly, the one or more water inlet passages comprise a first water inlet passage connected to the control assembly and the connector assembly and a second water inlet passage connected to the faucet and the connector assembly, and the one or more water outlet passages comprise a first water outlet passage connected to the control assembly and the connector assembly and a second water outlet passage connected to the faucet and the connector assembly.

8. The remote control water outlet device according to claim 7, wherein:

the connector assembly comprises a connector body, and the first water inlet passage, the second water inlet passage, the first water outlet passage, and the second water outlet passage are all detachably connected to the connector body.

9. The remote control water outlet device according to claim 8, wherein the connector body is disposed with a check valve at a connection position between the connector body and the second water inlet passage.

10. The remote control water outlet device according to claim 1, wherein:

the faucet comprises a switching valve configured to be in communication with the one or more water inlet pipes and the water outlet pipe assembly, and the switching valve controls the water outlet pipe assembly to be opened and to be closed.

* * * * *